United States Patent [19]

Sweeney

[11] Patent Number: 4,834,620

[45] Date of Patent: May 30, 1989

[54] LOW HORSEPOWER APPARATUS AND TECHNIQUE FOR RAISING LIQUID ABOVE THE STATIC SURFACE LEVEL THEREOF

[75] Inventor: Gerald T. Sweeney, Puyallup, Wash.

[73] Assignee: Aardvark Corporation, Puyallup, Wash.

[21] Appl. No.: 180

[22] Filed: Jan. 2, 1987

[51] Int. Cl.[4] ..... F04B 17/00; F04B 35/00

[52] U.S. Cl. ..... 417/53; 417/552; 417/233; 92/109; 92/137

[58] Field of Search ..... 74/37, 53; 272/73; 92/137; 417/233, 545–554, 415, 244, 374

[56] References Cited

U.S. PATENT DOCUMENTS

| | | | |
|---|---|---|---|
| 350,805 | 10/1886 | Chew | 417/552 |
| 1,756,089 | 4/1930 | Hunter | 74/37 |
| 3,040,673 | 6/1962 | Dunbar | 92/109 |
| 3,270,687 | 9/1966 | Hettinga | 417/547 |
| 3,547,083 | 12/1970 | Peterson | 417/545 |
| 3,684,410 | 8/1972 | Fitzgerald | 417/545 |
| 4,249,750 | 2/1981 | Kantner | 418/61 R |
| 4,303,833 | 12/1981 | Eckel | 417/244 |

FOREIGN PATENT DOCUMENTS

| | | | |
|---|---|---|---|
| 11160 | 1/1928 | Australia | 417/550 |
| 2441070 | 7/1980 | France | 417/552 |
| 2070697 | 9/1985 | United Kingdom | 417/552 |

*Primary Examiner*—William L. Freeh

*Attorney, Agent, or Firm*—Christopher Duffy

[57] ABSTRACT

To achieve a flywheel effect and lower the power necessary to drive it, a float pump is modified and put to use in such a way that one-half of the stroke of the pump is powered by the negative or positive buoyancy of the system of reciprocating components through which the pump is operated. As a result, the pump can be powered by even human leg power, such as by driving it through a pair of cranks pedalled in the manner of a bicycle. A reciprocable drive mechanism for the pump is also disclosed and claimed.

39 Claims, 4 Drawing Sheets

Fig. 6
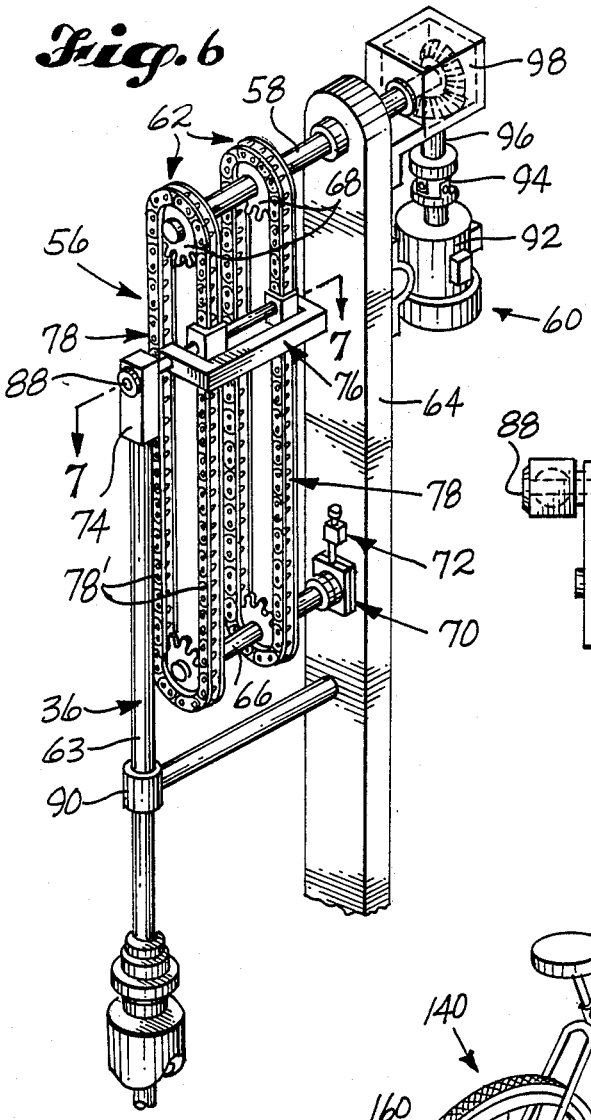
Fig. 7
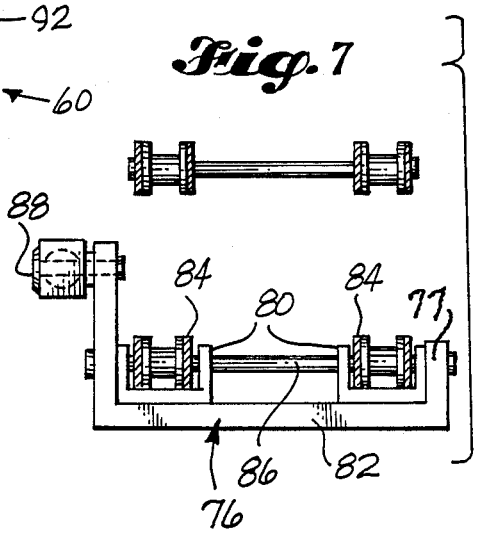
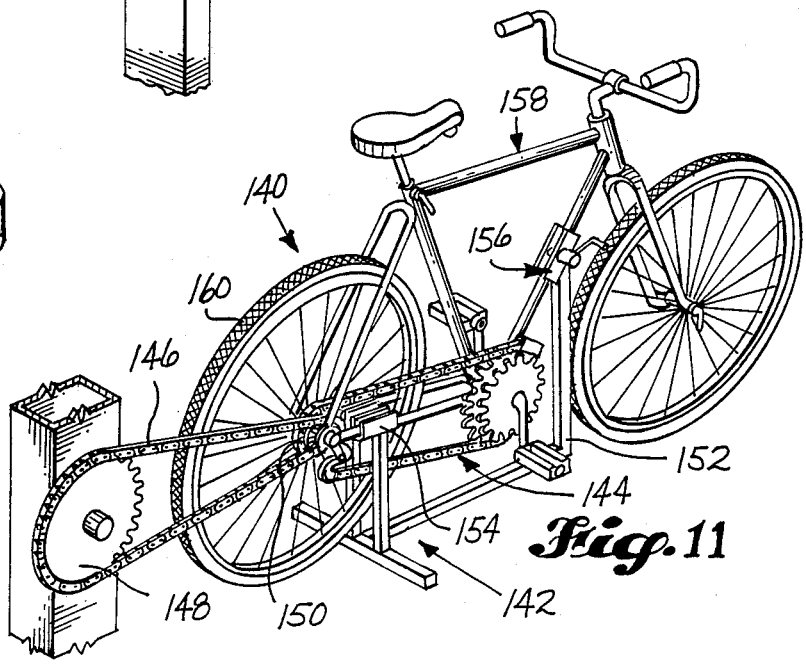
Fig. 11

LOW HORSEPOWER APPARATUS AND TECHNIQUE FOR RAISING LIQUID ABOVE THE STATIC SURFACE LEVEL THEREOF

TECHNICAL FIELD

This invention relates to a low horsepower apparatus and technique for raising liquid above the static surface level thereof, and particularly one using a float pump for this purpose. It also relates to a reciprocable drive mechanism with which to operate the pump, including operating it manually, if desired.

BACKGROUND ART

Float pumps have been long used as a means for raising a liquid above the static surface level thereof. But the pumps of this type have commonly had a short stroke requiring considerable horsepower to effect the pumping operation. The present invention provides an apparatus and technique whereby the stroke can be lengthened and the horsepower requirement can be drastically reduced, and in fact reduced to a level at which the pump can be operated manually, even in raising the liquid from great depths below the static surface level thereof, and/or raising it to considerable heights thereabove. In particular, the pump can be operated by a person pedalling a pair of cranks with his legs, for example, in the manner in which a bicycle is pedalled.

When a float pump is put to use, the distal end portion of the same is inserted downward into the body of liquid until the intake of the tubular case of the same is immersed below the static surface level of the liquid. Meanwhile, the proximal end portion of the case is retained above the static surface level of the liquid, to discharge the pump effluent thereabove, and the piston rod of the pump is extended from the bore of the case to a point above the discharge, to enable the piston to be reciprocated therefrom, there being an annulus defined between the rod and the case in the bore thereof within which the liquid is lifted by the piston to the discharge of the case.

Since the piston is immersed in the body of liquid, it is subjected to hydrostatic forces. These may have a tendency to raise the piston out of the bottom of its stroke until its center of buoyancy and center of gravity reach a state of equilibrium. This tendency is a function, however, of the weight of the column of liquid in the annulus, the friction between the piston and the case, and the presence of any artesian forces acting on the piston. It is also a function of the buoyancy inherent in the piston itself, including the piston rod which is a part of the same, and the connection between the rod and the drive mechanism for reciprocating the piston.

The piston may also have a tendency to sink at the top of its stroke. This is a function of the weight of the piston, as well as any liquid which was not discharged from the annulus on the upstroke of the piston. The tendency is counteracted, of course, by the friction encountered by the piston, and by the resistance offered by the liquid captured between the piston and the intake of the case.

The tendency of the piston to rise can be referred to as "positive buoyancy" and the tendency to sink can be referred to as "negative buoyancy."

DISCLOSURE OF INVENTION

According to the present invention, the float pump is somewhat lengthened or elongated over those used in the past and is operated through a reciprocable drive mechanism which has a reciprocably driven shuttle therein to which the stroke of the pump is closely tied. As in the past, the distal end portion of the pump is inserted downward into the body of liquid until the intake of the elongated tubular case of the same is immersed below the static surface level of the liquid. The proximal end portion of the case is retained, meanwhile, above the static surface level of the liquid, to discharge the pump effluent thereabove; and the piston rod of the pump is extended from the bore of the case to a point above the discharge to enable the piston to be reciprocated therefrom. The shuttle of the drive mechanism is connected to the piston rod at the aforesaid point so that the piston, the rod, and the shuttle conjointly reciprocate with one another as a unitary servo-system having a predetermined stroke parallelling the longitudinal axis of the case; and the drive mechanism is operated to reciprocate the servo-system and thereby take in the liquid and discharge it from the case through the annulus defined between the rod and the case in the bore thereof. As the drive mechanism is operated, however, the intake of the case is stationed at a depth in the body of liquid at which the piston rod has an immersed length, relative to the buoyancy of the servo-system and the weight of the liquid column in the annulus, at which the center of buoyancy and the center of gravity of the servo-system reach a state of equilibrium each time that the servo-system passes through an intermediate point within the stroke thereof, so that a portion of the stroke, in each direction thereof, is powered by the negative or positive buoyancy of the servo-system. In this way, it is possible to employ a low horsepower source in operating the drive mechanism since the respective buoyancies of the servo-system have a "flywheel" effect enabling the servo-system to be driven through the balance of its stroke, in each direction, by only that power needed to preserve the momentum given the servo-system in the first portion of its stroke by the respective buoyancy acting thereon. In fact, even when the intake is immersed at great depths in the body of liquid, the drive mechanism may be operated by as little horsepower as that generated by a person pedalling a pair of cranks with his legs,such as someone pedalling the cranks of a conventional bicycle-type chain and sprocket power system for the same.

Preferably, the intake of the case is immersed to a depth at which a state of equilibrium is reached each time that the servo-system passes through the mid-point of the stroke thereof, so that one-half of the stroke, in each direction thereof, is powered by the negative or positive buoyancy of the servo-system.

Preferably, too, the shuttle undergoes lost motion at each end of the stroke of the servo-system so that the check valves in the intake and piston of the pump can fully open and close, respectively, for and against flow therethrough, or vice versa, before the servo-system resumes reciprocation in the opposing direction thereof.

In addition to being raised from great depths, the liquid may also be raised to a level above the discharge of the case. For example, the top of the case may be extended above the discharge level thereof, the piston rod may be slidably engaged with the top of the case to seal the top against discharge therethrough from the annulus, and the discharge may have an extension thereon which raises the liquid to a level above the top of the case.

If the body of liquid has sufficient depth and/or artesian head to accomodate the intake within it, the intake need only be inserted into the body of liquid to the necessary depth at or above the bottom of the enclossure therefor. However, where the body of liquid has insufficient depth and/or artesian head to accomodate the intake within it, it may be necessary to form a sump in the bottom of the enclosure for the body of liquid, and to insert the pump into the sump to place the intake at a depth therein at which the piston rod has the necessary length. Moreover, where the material at the bottom of the enclosure is relatively liquid pregnable, it may be necessary to case the sump with a thimble-like water-tight liner for the same.

The body of liquid may have a static surface level above the surface of the ground, or below the surface of the ground.

If the body of liquid is enclosed in a ground formation and the surface of the ground is contoured to have two or more tiers of surface, a plurality of float pump units may be inserted in the ground formation, one below each tier, and the liquid may be raised by each unit to the next successive tier thereabove, to discharge thereon.

Not only may the drive mechanism be operated by someone pedalling the cranks of a conventional bicycle-type chain and sprocket power system for the same, but he may in fact pedal a conventional bicycle temporarily immobilized in a stand while the power system of the same is interconnected with the drive mechanism. The bicycle is then available for purposes of accessing to and from the site of the pump, as well as operating the drive mechanism.

The apparatus comprises an elongated tubular float pump, the distal end portion of which is insertable downwardly into a body of liquid to immerse the intake of the elongated tubular case of the same below the static surface level of the liquid while the proximal end portion of the case is retained above the static surface level of the liquid, to discharge the pump effluent thereabove, and the piston rod of the pump is extended from the bore of the case to a point above the discharge to enable the piston to be reciprocated therefrom. As indicated, it also comprises a reciprocable drive mechanism which has a reciprocably driven shuttle therein that is connectible to the piston rod at the aforesaid point, so that the piston, the rod, and the shuttle are conjointly reciprocable with one another as a unitary servo-system having a predetermined stroke parallelling the longitudinal axis of the case. In addition, there are means for operating the drive mechanism to reciprocate the servo-system and thereby take in the liquid and discharge it from the case through the annulus defined between the rod and the case in the bore thereof. And as indicated earlier, the case and the rod have a length,relative to the buoyancy of the servo-system and the projected weight of the liquid column in the annulus, whereby the intake of the case can be stationed at a depth in the body of liquid at which the center of buoyancy and the center of gravity of the servo-system reach a state of equilibrium each time that the servo-system passes through an intermediate point within the stroke thereof. In this way, a portion of the stroke, in each direction thereof, will be powered by the negative or positive buoyancy of the servo-system, as indicated earlier.

Once again, the case and the rod preferably have a length whereby the intake of the case can he immersed to a depth at which the state of equilibrium is reached each time that the servo-system passes through the mid-point of the stroke thereof, so that one-half of the stroke, in each direction thereof, is powered by the negative or positive buoyancy of the servo-system.

Moreover, the shuttle preferably undergoes lost motion at each end of the stroke of the servo-system to enable the check valves of the intake and piston to open and close more fully, as indicated earlier.

Often, the apparatus further comprises means for raising the liquid to a level above the discharge of the case. In certain of the presently preferred embodiments of the invention, for example, the top of the case is extended above the discharge level thereof, the piston rod is slidably engaged with the top of the case to seal the top against discharge therethrough from the annulus, and the discharge has an extension thereon which raises the liquid to a level above the top of the case.

For the reasons given earlier, the apparatus may further comprise means for forming a sump in the bottom of the enclosure for the body of liquid, so that the intake of the case can be inserted in the sump to a level therein at which the piston rod has the necessary length. In addition, the apparatus may further comprise means for casing the sump with a thimble-like water-tight liner for the same, where the material at the bottom of the enclosure is relatively liquid pregnable.

To adjust the buoyancy of the servo-system, the piston rod may have a longitudinally extending cavity in the bore thereof. The cavity may be hollow, or it may be filled with a buoyancy adjusting filler material, such as a closed cell, expanded polymeric foam material. The rod itself may be constructed from the group consisting of light weight metal and polymer materials adapted to withstand the hydrostatic pressures ambient to the pump.

The means for operating the drive mechanism may be manually operable, as indicated; and in some of the presently preferred embodiments of the invention, may include a pair of crank arms adapted to be pedalled by a person with his legs. In certain presently preferred embodiments of the invention, the operating means include a stand for immobilizing a conventional bicycle while it is pedalled by a person sitting on the same, and means whereby the chain and sprocket power system of the bicycle can be interconnected with the drive mechanism to operate the same through the pedalling action of the person sitting on the bicycle.

In many of the presently preferred embodiments of the invention, the piston rod is guided to reciprocate along the axis of the case, and the shuttle is pivotally supported on the rod to rotate between opposing sides of one axial plane thereof. The drive mechanism is operable to conjointly reciprocate the shuttle and the piston rod in a predetermined stroke parallelling the plane, and alternately, to rotate the shuttle between the opposing sides of the plane when the piston rod is disposed at the opposing ends of the stroke of the same.

In some of these embodiments, the drive mechanism comprises a pair of power-driven wheels mounted for rotation about spaced parallel axes coinciding with the aforesaid one axial plane of the rod; a closed loop belt which is engaged about the wheels to be rotated with the same in an oblong path extending between and about the axes thereof; and means whereby the shuttle is affixed to a point on the belt to reciprocate with the same as it travels between the wheels, and alternately, to rotate about the wheels as the point travels around the same at the respective ends of the path of the belt.

In certain presently preferred embodiments of the invention, the shuttle takes the form of an L-shaped arm, one end portion of which is pivotally supported on the piston rod and the other end portion of which is bracketed about the outside of the belt and fixedly interconnected with the point on the belt to travel with the same in the path thereof between and about the axes of the wheels. In some embodiments, the belt takes the form of a closed loop chain which is engaged about a pair of power-driven sprockets to be rotated with the same in an oblong path extending between and about the axes of the sprockets. The aforesaid other end portion of the arm is equipped with a U-shaped bracket which is clasped about and rigidly fastened to a link of the chain by means of a pin inserted therethrough.

BRIEF DESCRIPTION OF THE DRAWINGS

These features will be better understood by reference to the accompanying drawings which illustrate certain presently preferred embodiments of the invention wherein the float pump is employed in a water well that is overdrilled in the ground to provide a sump to accomodate the pump.

In the drawings:

FIG. 6 is a part perspective view of the well head in greatly enlarged scale;

FIG. 7 is a cross-sectional view of the well head along the line 7—7 of FIG. 6;

FIG. 11 is another perspective view showing an alternative form of power source for use at the head of the well seen in FIG. 1–10.

BEST MODE FOR CARRYING OUT THE INVENTION

Figure 2:
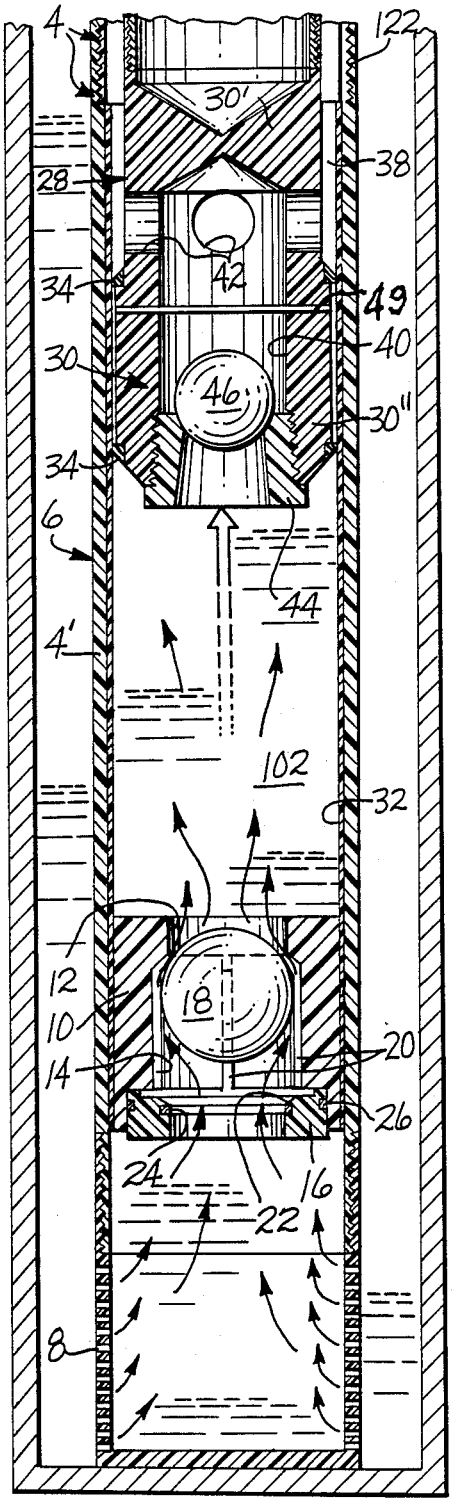
FIG. 2 is a relatively enlarged cross-section of the well in the same plane, but at the sump end thereof only.
Figure 3:
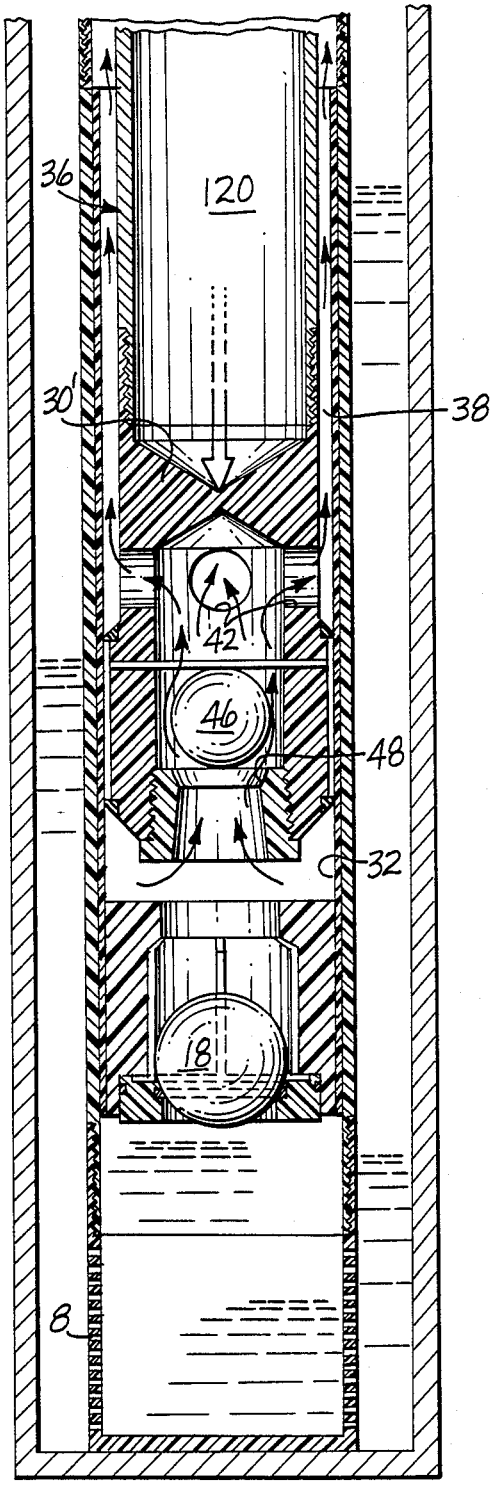
FIG. 3 is a similar relatively enlarged cross-section of the well at the sump end thereof, but showing a different stage in the operation of the pump.

Referring first to FIGS. 1–8 in particular, it will be seen that the float pump 2 in the well 3 comprises a string of elongated tubular casing sections 4 (FIGS. 2 and 3) which are flush coupled to one another to form the case 6 of the pump. A tubular screen 8 is threaded to the distal end of the case, to form the bottom of the pump, and there is a bulkhead 10 formed across the distal section 4' of the case, just inside of the screen, which has an axially extending passage 12 therethrough, forming the intake of the pump. The passage 12 is counterbored at the lower end thereof, and the mouth of the counterbore 14 is rabbetted in turn to form a seat for a bushing 16 (FIGS. 2 and 3) acting to hold a ball valve 18 captive within the recess of the bore 14. The ball valve 18 is caged within a set of axially extending ribs 20 on the wall of the bore, and when closed, seats against a taper 22 rabbetted into the inside face of the bushing 16. The ball valve functions as a check valve for the intake 12, in that, as seen in FIG. 2, liquid can enter the passage 12 between the ribs 20 of the bore, but cannot flow in the reverse direction outward of the passage after the valve 18 has seated against the bushing. A pair of ring seals 24 and 26 at the inner and outer peripheries of the bushing assure that the valve has integrity when it is closed.

The pump 2 also comprises a double-acting piston 28 which is slidably engaged in the cylinder 5 formed by the distal end section 4' of the case 6. The cylinder is lined with TEFLON, and the relatively enlarged head 30 of the piston is slidably inserted within the liner 32 to be reciprocated with respect to the intake 12, on one hand, and with respect to the proximal end section 4'' or sections of the case, on the other. A pair of sliding seals 34 serves to seal off the two sides of the head from one another while the piston is undergoing reciprocation; and the reciprocable motion is imparted to the piston by a piston rod 36 which is flush coupled to the upper end portion 30' of the head. The rod 36 and the upper end portion 30' of the head are reduced in diameter, moreover, relative to the forward end 30'' of the head, so that there is an annulus 38 formed between the rod and the wall of the case 6. Meanwhile, a socketlike recess 40 in the forward end 30'' of the head, extends axially inwardly of the head to a point in the reduced upper end portion 30' of the same where it opens into the annulus 38 through a series of ports 42 extending radially about the recess 40. In addition, a flanged bushing 44 is threaded into the mouth of the recess, and an additional ball valve 46 is held captive within the recess by the bushing. This additional valve 46 operates as a check valve for the piston, and seats against a taper 48 in the upper end of the bushing 44, allowing liquid to flow upward through the head 30 and into the annulus 38 of the case, but not in the reverse direction when the valve 46 is seated against the top of the bushing.44. A pin 49 across the upper end of the recess 40 prevents the valve 46 from closing the ports 42.

The piston rod 36 is long enough to extend to a point above the proximal or upper end 4'' of the case; and is slidably guided in that end by a collar 50 forming a seal for the annulus 38. A spigot 52 opens into the atmosphere from the annulus immediately below the collar, and if desired, may have an extension 54 added to it so that it opens at a level above the upper end of the case. The spigot 52 serves to discharge liquid from the annulus, as shall be explained.

The piston rod 36 itself is reciprocated by a reciprocable drive mechanism 56 (FIGS. 4–7) which is connected with the rod and driven in turn by a shaft 58 at one end thereof. The shaft 58 is driven in turn by a power source 60 which can take any one of several forms, as shall be explained. As shall also be explained, the drive mechanism 56 has a degree of lost motion built into the same which allows the valves 18 and 46 to seat and unseat, whichever is the case, before the rod is reciprocated in the alternate direction thereof.

Referring in more detail to FIGS. 4–7, it will be seen that the piston rod 36 has a reduced diameter extension 63 thereon at a point above the top of the case, and the drive mechanism 56 comprises a pair of spaced parallel chain and sprocket transmissions 62 which are mounted on a stanchion 64 abreast of the extension 63. The spaced parallel shafts 58 and 66 of the transmissions are rotatably supported on the stanchion, in a plane coinciding with the extension of the rod, and the sprockets 68 of the transmissions are affixed to the shafts in planes perpendicular to the plane of the extension. The upper shaft 58 is journalled in the stanchion and driven by one of several power sources 60, as indicated. The lower shaft 66 is rotatably journalled in a slide block 70 which is mounted on the stanchion and under the control of a tensioning device 72,so that the tension of the chains 78 can be adjusted as needed.

The extension 63 of the piston rod has a cross-head 74 at the top thereof, and an L-shaped arm 76 is pivotally supported on the cross-head 74and outriggered therefrom so as to extend, yoke-like:about the outside of the chains 78. The yoke-like end 77 of the arm has a pair of U-shaped clasps 80 thereon, which are affixed to the inside bight·82 of the arm and abutted and fastened to corresponding links 84 of the chains by means of a pin 86 inserted therethrough from the arm. The arm 76 is thus constrained to shuttle back and forth with the links 84 of the chains, and as it does, to reciprocate the rod 36 as well, so long as the links 84 are travelling with the parallel lengths 78' of the chains. However, when the pivotal connection 88 between the arm 76 and the cross-head 74 reaches alignment with the axis of either shaft 58 or 66, the arm then undergoes rotation with the links about the sprockets 68 of the respective shaft until the links 84 reach the opposing side of the sprockets and resume travelling with the lengths 78' of the chains in the opposing direction. Within the pump 2 itself, this lost motion on the part of the arm 76 corresponds to the opening and closing positions of the valves 18 and 46, so that the valves have the full rotation of the arm about the sprockets within which to open and close, whichever is the case.

A sleeve 90 is cantilevered from the stanchion 64 below the drive mechanism 56 to guide the extension 63 of of the rod in its reciprocable path.

In FIGS. 4–7, the power source 60 comprises an electric motor 92 which is mounted in upended condition on the backside of the stanchion and connected to a speed reducer 94 thereabove. The shaft 96 of the speed reducer is connected, in turn, to the shaft 58 of the drive mechanism, by means of a pair of bevel gears 98 at the right angular juncture of the shafts.

The pump 2 operates in well known manner. The distal end portion 4' of the same is inserted into a body 100 of liquid until the intake 12 of the case 6 is immersed to a level below the static surface level 101 of the liquid. The proximal end portion 4'' of the pump is retained, meanwhile, above the static surface level of the liquid, and the power source 60 is employed to pump the liquid up through the length of the case 6. Initially, when the piston 28 is reciprocated relatively away from the bulkhead 10, the valve 18 opens and liquid is drawn in through the intake 12. The liquid collects in the gap 102 between the bulkhead and the piston; and when the piston is reversed and reciprocated toward the bulkhead, the liquid is forced up through the valve 46 and into the annulus 38 between the rod and the wall of the case. See FIG. 3. When the piston reaches the bottom of its stroke and is reversed again, it raises the column of liquid in the annulus, as the valve 18 re-opens and admits a new supply of liquid to the gap. See FIG. 2. The process is continued, and ultimately, as more and more liquid collects in the annulus, a steady flow of the same is sustained at the spigot 52, or the extension 54 of the same.

The pump 2 may be primed beforehand, to produce a steady flow at the outset, and to balance the output of the upstroke and downstroke, as shall be explained.

As was indicated earlier, when a pump of this type is put to use in a body of liquid, it is subjected to hydrostatic forces. When the piston 28 is driven upwardly by the drive mechanism 56, these forces lend themselves to the motion of the piston, and therefore, less driving force is needed to drive it. On the downstroke, however, the piston is working against these forces,and more driving force is needed to depress the piston. Of course, the piston is also working against the weight of the column of liquid in the annulus 38 on the upstroke; and on the downstroke, the liquid captured in the gap 102 between the piston and the intake offers resistance to the piston, while the liquid which remains in the annulus from the upstroke, in fact assists in the downstroke of the piston. Altogether then, there are many forces to balance within the pump—not to mention frictional forces—and the designer for the same faces a challenge in achieving an efficient result, particularly in choosing a power source adapted to reciprocate the piston the full length of its stroke. In fact, the designer is often limited to a relatively short stroke, since the power required to drive the piston is considerable, particularly if the piston is to undergo the full length of its stroke in each direction.

Actually, these forces can be used, if desired, to dramatically reduce the horsepower needed to operate the pump, and in fact to enable the pump to be operated by a low energy power source, such as a wave or solar energy power source, or even by human leg power, as shall be explained.

The drawings illustrate how this is accomplished. Turning again to FIGS. 1–3, it will be seen that the pump 2 has been put to use in raising water from an underground water bearing stratum 100. The stratum 100 is located below the surface 104 of the ground 106, and at a distance therebelow at which the pump 2 would normally be limited to raising the water at only the full horsepower conventionally used in the past. The stratum 100 is also subject to little or no artesian head, so that the water must be raised solely by the action of the pump.

According to the invention, in such a case, a sump 108 is excavated in the bottom 110 of the stratum, to a depth which enables thepump to be used in the inventive manner. In addition, assuming that the sump 108 is surrounded by a relatively water permeable material 106, it is cased off with a thimble-like casing 112 that extends to the surface 104 of the ground and has a screen 114 inserted therein at the level of the water bearing stratum 100. The casing 112 is also sealed off at the surface 104 of the ground by a collar 116 of concrete or similar material which acts not only to stabilize the casing in the ground,but also to seal it against surface drainage. Often a sealer ring 118 is used in conjunction with the pump, to stabilize it in the casing 112 and to prevent surface drainage into the same.

The sump 108 is added for the purpose of enabling the pump, and the piston rod 36 in particular, to be lengthened to that dimension at which the negative and positive buoyancies of the rod can be used as part of the means for driving the piston. That is, the rod 36 is given additional length, and/or length/width ratio, to increase its negative buoyancy, or capacity to sink on the downstroke; and at the same time, to give it a positive buoyancy which will tend to lift the column of water on the upstroke of the piston. More particularly, the rod is lengthened to a dimension at which the center of buoyancy and the center of gravity of the pump servo-system 28, 36, 74 and 76 as a whole, will reach a state of equilibrium each time that it passes through a predetermined point in the stroke thereof, and preferably, the midpoint in the stroke thereof. In this way, a portion of the stroke in each direction thereof, will be powered by the negative or positive buoyancy of the servo-system. This in turn makes it possible to employ a lower horsepower source 60 in operating the drive mechanism 56, since the source need only power the mechanism through the remaining half of the stroke of the servo-system, under the momentum the servo-system has from the first half of its stroke as a result of the negative or positive buoyancy therein. At the beginning of the downstroke of the drive mechanism, for example, the servo-system has sufficient sinking capacity or negative buoyancy to reach the midpoint of the stroke before power is needed from the source. Then, at the beginning of the upstroke of the mechanism, the servo-system has sufficient positive buoyancy to lift itself to the midpoint of the stroke. In each case, the power source 60 is required simply to preserve the momentum of the servo-system and to carry it through its stroke to the end thereof, where the arm 76 then undergoes lost motion before the positive or negative buoyancy of the servo-system acts once again to drive the mechanism in the opposite direction.

The effect is much like that of a flywheel, and tends to flatten out the power consumption, as well as reduce the level of power needed. The effect also enables the pump designer to give the piston a far longer stroke than would otherwise be the case.

In addition to providing for this balance of buoyancy and gravity at a predetermined point, such as the midpoint, in the stroke of the servo-system, it is also important that the pump 2 be designed to have a common output on its upstroke and downstroke, so that the balance is maintained throughout the operation of the pump. Furthermore, to enable the pump to commence pumping in a balanced state, it is ordinarily primed with water to the level of the discharge 52 before pumping is begun.

If the water bearing stratum 100 is under artesian head, the head is also taken into consideration. However, at full artesian head, i.e., at a free flowing condition, no pumping will be needed, other than in the case where it is desired to raise the water to a level above that achieved by the head alone.

Figure 5:
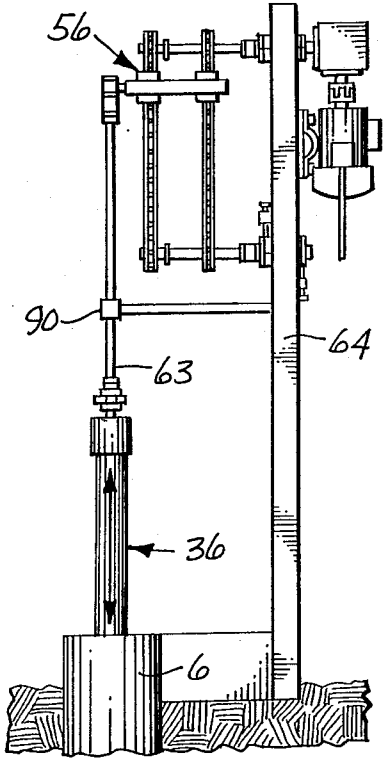
FIG. 5 is a similar view of the well at the head thereof, but from a perspective 90° apart from that of FIG. 4.
Figure 4:
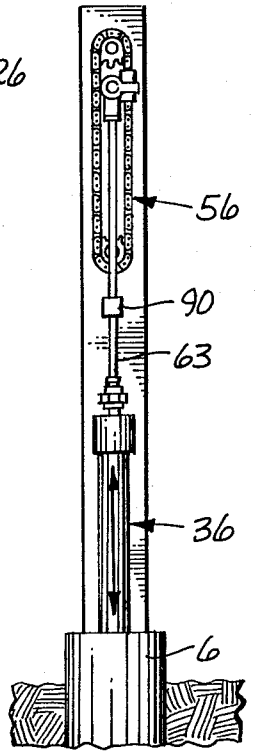
FIG. 4 is an elevational view of the well at the aboveground or head end thereof.

Instead of providing a spigot, the water may be discharged out the top of the case 6, as in FIGS. 4 and 5, if desired.

The buoyancy of the rod is a function, of course, not only of its length, and/or lengths/width ratio, but also the material or construction by which it is made. Referring again to FIGS. 1–7, it will be seen that the rod 28 has a hollow core 120 therein over the full length of the same. In addition, the rod is made of a light weight material, such as fiberglass, polyvinyl chloride, or even light gauge steel, which is capable of withstanding the hydrostatic pressures experienced by the pump, particularly when it is employed at great depths. The core 120 of the rod may be sealed under vacuum, such as by coupling each casing section 4 to the string under vacuum seal at the joint 122 (FIGS. 4 and 5) therebetween; or the core 120 may be filled with a light weight filler 124, such as an expanded, closed cell polymeric foam material which can withstand the pressures at which it will operate. See FIG. 8 and the rod 28' therein. Closed cell polyurethane and polystyrene filler materials are known for such a purpose. The latter approach has the advantage that the joints 122 of the rod 28' need not be sealed as the sections are added to the string. This sealing process is time-consuming in that each joint 122 requires time to cure before it can be immersed in water.

Figure 10:
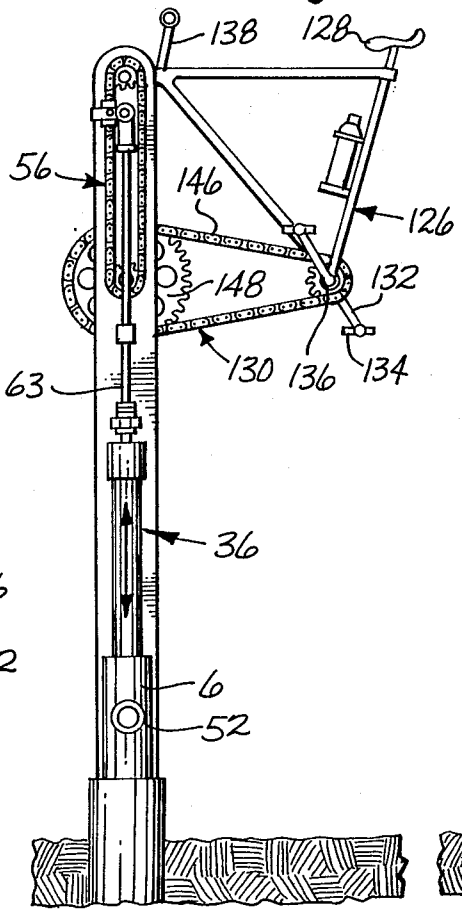
FIG. 10 is another such view, but showing the well head at 90° to that of FIG. 9.
Figure 9:
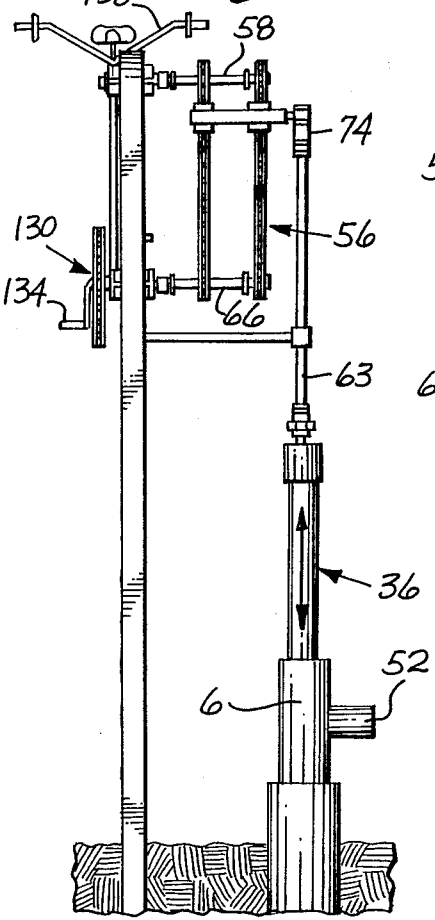
FIG. 9 is an elevational view similar to that of FIG. 4, but from the opposite perspective and showing an alternative form of power source for the drive mechanism of the well.

As was indicated earlier, the low horsepower requirements of the pump 2 enable it to be driven by human leg power alone, if desired. Referring to FIGS. 9 and 10, it will be seen that a bicycle-style seat frame 126 is mounted on the backside of the stanchion 64, with a seat 128 thereon; and an additional chain and sprocket transmission 130 is arranged between the frame 126 and the lower shaft 66 of the drive mechanism 56 to drive it, rather than the upper shaft 58. Moreover, a pair of conventional bicycle-style cranks 132, with foot pedals 134, is secured to the power sprocket 136 of the transmission 130 so that someone sitting on the frame can pedal the drive mechanism 56 in bicycle fashion.

Ordinarily, a pair of handlebars 138 are added to the stanchion or the frame 126, to provide a more comfortable pedalling stance for the driver (not shown) on the frame.

If desired, an actual bicycle 140 can be used to power the drive mechanism 56, for example, after the bicycle is first used in conventional fashion to reach the site of the well 3. Referring now to FIG. 11, it will be seen that a crib 142 has been provided with which to immobilize the bicycle while the drive mechanism 144 of the same is employed to power the pump through a chain 146 and sprocket 148 transmission similar to that used in FIGS. 9 and 10, but arranged between the crib and the stanchion. In this instance, the chain 146 is equipped with a master link (not shown) that is removable to enable the chain to be roved about one of the unused sprockets 150 of the derailleur assembly on the bicycle after the other end of the chain is roved about the sprocket 148 on the stanchion. The driver then reseats himself on the bicycle and pedals it in conventional fashion to power the pump through the chain 146 and sprocket 148.

Ordinarily, the crib 142 comprises a stand 152 having a pair of cradles 154 and 156 adapted to receive the lower horizontal and front oblique members of the frame 158 of the bicycle, the cradle 154 for the horizontal member being elevated to raise the rear wheel 160 of the bicycle off the ground.

Figure 1:
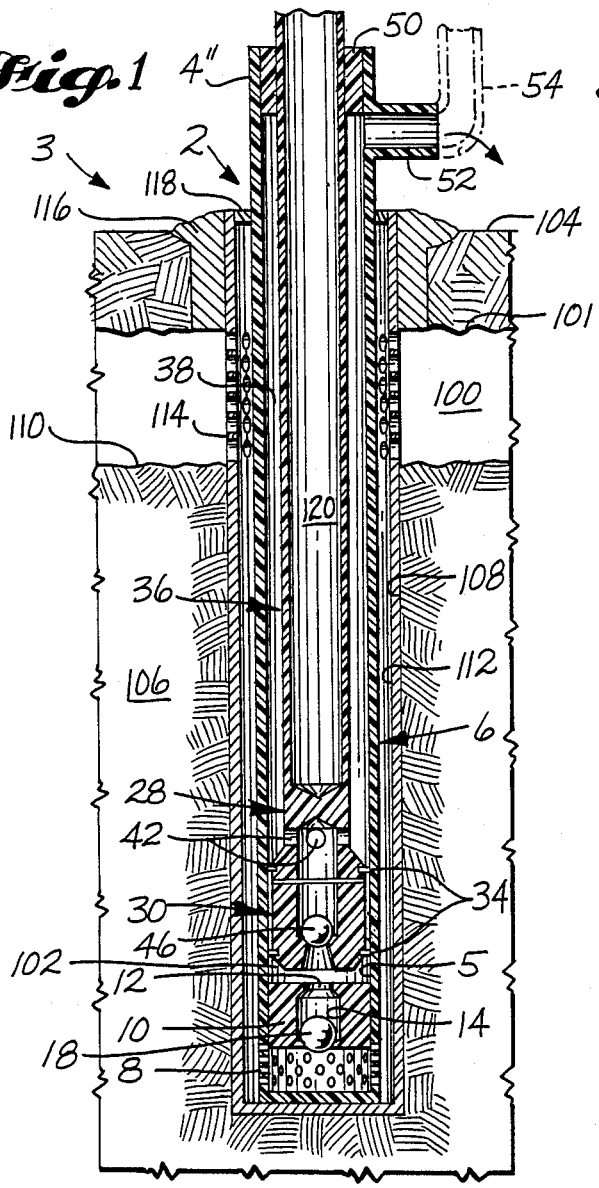
FIG. 1 is a vertical cross-section of the well when the sump end of the same has been cased and equipped with an elongated float pump of the nature described.
Figure 8:
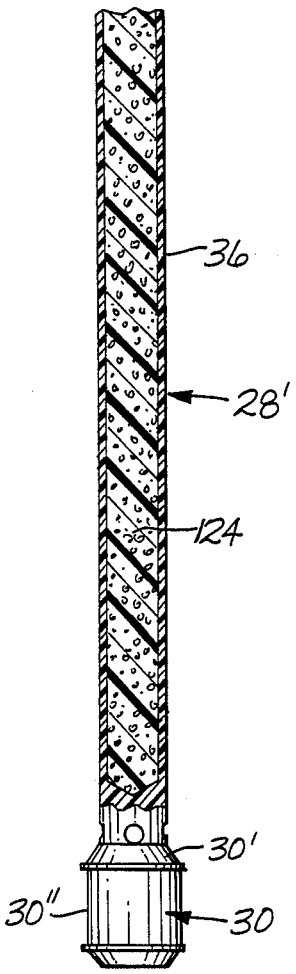
FIG. 8 is a part cross-sectional view of an alternative form of piston employable in the pump of FIGS. 1–7.
Figure 12:
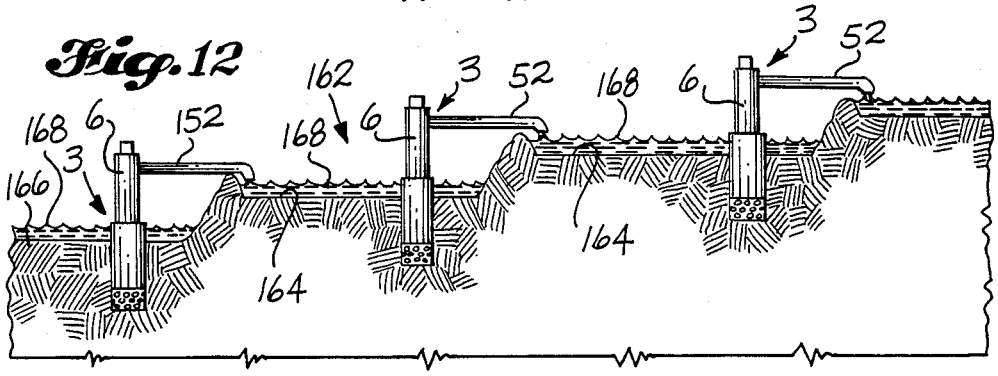
FIG. 12 is a part cross-sectional view of a multitiered rice paddy, or the like, employing a plurality of wells for raising the water from one tier to the next in the paddy.

The apparatus and technique may also be employed in the situation wherein the static surface level of the water is above ground, such as in the case of the multi-tiered rice paddy 162 seen in FIG. 12. In this instance, a plurality of wells 3 is employed, one for each tier 164 of the paddy, including the unraised rice field 166 at the bottom of the paddy. In certain parts of the world, such as in the Orient, pools 168 of water are maintained on the fields by progressively elevating the water on the bottommost field to each tier thereabove until all of the tiers are covered by water. Using the multi-pump apparatus seen in FIG. 12, each tier can be flooded and maintained by pumping from the next successive tier therebelow, perhaps using a bicycle or the bicycle-like mount of FIGS. 9–11 as the means for powering the respective pumps. In fact, a single driver (not shown) might service the entire paddy by first mounting the drive for the bottomost pump, and then moving progressively up the flight of tiers until the water has been ponded on each tier, including the uppermost of the same.

I claim:

1. A method of raising submerged liquid to the atmosphere above the static level thereof, comprising:

inserting downward into the body of liquid, the distal end portion of the elongated tubular case of a float pump having an intake and a discharge in the distal and proximal end portions of the case, respectively, a piston in the bore of the case, and a rod for reciprocating the piston in the bore, the piston rod extending from the bore to a point above the discharge, to enable the piston to be reciprocated therefrom, and being closed to the liquid, but there being a liquid flow annulus formed in the bore between the rod and the wall of the bore, which opens to atmosphere at the discharge, and valve means whereby the liquid is intaken through the piston to the annulus and then delivered to the discharge through the annulus, immersing the intake below the static surface level of the liquid, while retaining the proximal end portion of the case in the atmosphere above the static surface level of the liquid to discharge the annulus to the atmosphere, connecting a reciprocable drive mechanism to the piston rod at the aforesaid point so that the piston, the rod, and the connection between the rod and the drive mechanism are constrained to reciprocate with one another as a unitary servo-system having a predetermined stroke paralleling the longitudinal axis of the case, operating the drive-mechanism to reciprocate the servo-system at such stroke, adjusting the weight of the piston rod to increase the buoyancy of the servo-system, and adjusting the length of the rod and the annulus and the level of the discharge commensurately so that when the annulus is flooded to the level of the discharge, the piston rod has an immersed length relative to the increased buoyancy of the servo-system and the weight of the column of the liquid in the annulus, at which the center of buoyancy and the center of gravity of the servo-system reach a state of equilibrium each time that the servo-system passes through an intermediate point within the stroke thereof, so that a portion of the stroke, in each direction thereof, is powered by the negative or positive buoyancy of the servo-system.

2. The method according to claim 1 wherein the intake of the case is immersed to a depth at which a state of equilibrium is reached each time that the servo-system passes through the mid-point of the stroke thereof, so that one-half of the stroke, in each direction thereof, is powered by the negative or positive buoyancy of the servo-system.

3. The method according to claim 1 wherein the connection undergoes lost motion at each end of the stroke of the servo-system so that the check valves in the intake and piston of the pump can fully open and close, respectively, for and against flow therethrough, or vice versa, before the servo-system resumes reciprocation in the opposing direction thereof.

4. The method according to claim 1 wherein the liquid is raised to a level above the discharge of the case.

5. The method according to claim 1 wherein the top of the case is extended above the discharge level thereof, the piston rod is slidably engaged with the top of the case to seal the top against discharge therethrough from the annulus, and the discharge has an extension thereon which raises the liquid to a level above the top of the case.

6. The method according to claim 1 wherein the body of liquid has sufficient depth and/or artesian head to accomodate the intake within it, and the intake is inserted into the body of liquid to the necessary depth at or above the bottom of the enclosure thereof.

7. The method according to claim 1 wherein the liquid has a static surface level above the surface of the ground.

8. The method according to claim 1 wherein the liquid has a static surface level below the surface of the ground.

9. The method according to claim 1 wherein the body of liquid is enclosed in a ground formation, the surface of the ground is contoured to have two or more tiers of surface, a plurality of float pump units is inserted in the ground formation, one below each tier, and the liquid is raised by each unit to the next successive tier thereabove, to discharge thereon.

10. The method according to claim 1 wherein the drive mechanism is operated manually.

11. The method according to claim 1 wherein the drive mechanism is operated by someone pedalling a conventional bicycle temporarily immobilized in a stand while the chain and sprocket power system of the same is interconnected with the drive mechanism.

12. The method according to claim 1 wherein the body of liquid has insufficient depth and/or artesian head to accomodate the intake within it, and wherein a sump is formed in the bottom of the enclosure for the body of liquid, and the pump is inserted into the sump to place the intake at a depth therein at which the piston rod has the necessary length.

13. The method according to claim 12 wherein material at the bottom of the enclosure is relatively liquid pregnable, and the sump is cased with a thimble-like water-tight liner for the same.

14. A low-horsepower apparatus for raising submerged liquid to the atmosphere above the static surface level thereof, comprising a float pump comprising an elongated tubular case having an intake and a discharge in the distal and proximal end portions thereof, respectively, a piston in the bore of the case, and a rod for reciprocating the piston in the bore, the piston rod extending from the bore to a point beyond the discharge, to enable the piston to be reciprocated therefrom, and being operatively closed to the liquid, but there being a liquid flow annulus formed in the bore between the rod and the wall of the bore, which opens to atmosphere at the discharge, and valve means whereby the liquid is operatively intaken through the piston to the annulus and then delivered to the discharge through the annulus, a reciprocable drive mechanism connectible to the piston rod at the aforesaid point so that the piston, the rod, and the connection between the rod and the drive mechanism are constrained to reciprocate with one another as a unitary servo-system having a predetermined stroke paralleling the longitudinal axis of the case, and means for operating the drive mechanism to reciprocate the servo-system at such stroke, the weight of the piston rod being adjusted to increase the buoyancy of the servo-system, and the length of the rod and the annulus and the level of the discharge being adjusted commensurately so that when the distal end portion of the case is inserted downward into the body of liquid to immerse the intake of the same below the static surface level of the liquid, the proximal end portion of the case is retained in the atmosphere above the static surface level of the liquid to discharge the annulus to the atmosphere, and the annulus is flooded to the level of the discharge, the piston rod has an immersed length relative to the increased buoyancy of the servo-system and the weight of the column of liquid in the annulus, at which the center of buoyancy and the center of gravity of the servo-system reach a state of equilibrium each time that the servo-system passes through an intermediate point within the stroke thereof, so that a portion of the stroke, in each direction thereof, is powered by the negative or positive buoyancy of the servo-system.

15. The apparatus according to claim 14 wherein the drive mechanism has a reciprocably driven shuttle therein to which the piston rod is connected.

16. The apparatus according to claim 14 wherein the case and the rod have a length whereby the intake of the case can be immersed to a depth at which the state of equilibrium is reached each time that the servo-system passes through the midpoint of the stroke thereof, so that one-half of the stroke, in each direction thereof, is powered by the negative or positive buoyancy of the servo-system.

17. The apparatus according to claim 14 wherein the connection undergoes lost motion at each end of the stroke of the servo-system so that the check valves in the intake and piston of the pump can fully open and close, respectively, for and against flow therethrough, or vice versa, before the servo-system resumes reciprocating in the opposing direction thereof.

18. The apparatus according to claim 14 further comprising means for raising the liquid to a level above the discharge of the case.

19. The apparatus according to claim 14 wherein the top of the case extends above the discharge level thereof, the piston rod is slidably engaged with the top of the case to seal the top against discharge therethrough from the annulus, and the discharge has an extension thereon to raise the liquid to a level above the top of the case.

20. The apparatus according to claim 14 further comprising means for forming a sump in the bottom of the enclosure for the body of liquid, so that the intake of the case can be inserted in the sump to a level therein at which the piston rod has the necessary length.

21. The apparatus according to claim 20 further comprising means for casing the sump with a thimble-like water-tight liner for the same, where the material at the bottom of the enclosure is relatively liquid pregnable.

22. The apparatus according to claim 14 wherein the piston rod has a longitudinally extending cavity in the bore thereof.

23. The apparatus according to claim 22 wherein the cavity is hollow.

24. The apparatus according to claim 22 wherein the cavity is filled with a buoyancy adjusting filler material.

25. The apparatus according to claim 14 wherein the piston rod is constructed from the group consisting of light weight metal and polymer materials adapted to withstand the hydrostatic pressures ambient to the pump.

26. The apparatus according to claim 14 wherein the means for operating the drive mechanism are manually operable.

27. The apparatus according to claim 14 wherein the means for operating the drive mechanism include a stand for immobilizing a conventional bicycle while it is pedalled by a person sitting on the same, and means whereby the chain and sprocket power system of the bicycle can be interconnected with the drive mechanism to operate the same through the pedalling action of the person sitting on the bicycle.

28. The apparatus according to claim 14 wherein the piston rod is guided to reciprocate along the axis of the case, the shuttle is pivotally supported on the rod to rotate between opposing sides of one axial plane thereof, and the drive mechanism is operable to conjointly reciprocate the shuttle and the piston rod is a predetermined stroke paralleling the plane, and alternately, to rotate the shuttle between the opposing sides of the plane when the piston rod is disposed at the opposing ends of the stroke of the same.

29. The apparatus according to claim 28 wherein the drive mechanism comprises a pair of power driven wheels mounted for rotation about spaced parallels axes coinciding with the aforesaid one axial plane of the rod, a closed loop belt which is engaged about the wheels to be rotated with the same in an oblong path extending between and about the axes thereof, and means whereby the shuttle is affixed to a point on the belt to reciprocate with the same as it travels between the wheels, and alternately, to rotate about the wheels as the point travels around the same at the respective ends of the path of the belt.

30. The apparatus according to claim 29 wherein the shuttle takes the form of an L-shaped arm, one end portion of which is pivotally supported on the piston rod and the other end portion of which is bracketed about the outside of the belt and fixedly interconnected with the point on the belt to travel with the same in the path thereof between and about the axes of the wheels.

31. The apparatus according to claim 30 wherein the belt takes the form of a closed loop chain which is engaged about a pair of power driven sprockets to be rotated with the same in an oblong path extending between and about the axes of the sprockets, and the aforesaid other end portion of the arm is equipped with a U-shaped bracket which is clasped about and rigidly fastened to a link of the chain by means of a pin inserted therethrough.

32. A method of raising liquid above the static surface level thereof with a float pump comprising an elongated tubular case having an intake and a discharge in the distal and proximal end portions thereof, respectively, a piston in the bore of the case, and a rod for reciprocating the piston in the bore, there being a liquid flow annulus formed in the bore between the rod and the wall of the bore, and valve means whereby the liquid is intaken through the piston to the annulus and then delivered to the discharge through the annulus, comprising inserting the distal end portion of the case downward into the body of liquid until the intake of the same is immersed below the static surface level of the liquid, retaining the proximal end portion of the case above the static surface level of the liquid, to discharge the pump effluent thereabove, extending the piston rod from the bore of the case to a point above the discharge, to enable the piston to be reciprocated therefrom, connecting a reciprocable drive mechanism to the piston rod at the aforesaid point so that the piston, the rod, and the connection between the rod and the drive mechanism are constrained to reciprocate with one another as a unitary servo system having a predetermined stroke paralleling the longitudinal axis of the case, operating the drive mechanism by pedalling the cranks of a conventional bicycle-type chain and sprocket power system to reciprocate the servo system at such stroke, and adjusting the level of the intake and flooding the pump to levels in the body of liquid and the annulus, respectively, at which the piston rod has an immersed length, relative to the bouyancy of the servo system and the weight of the column of liquid in the annulus, at which the center of bouyancy and the center of gravity of the servo system reach a state of eualibrium each time that the servo-system passes through an intermediate point within the stroke thereof, so that a portion of the stroke, in each direction thereof, is powered by the negative or positive bouyancy of the servo-system.

33. A low horsepower apparatus for raising liquid above the static surface level thereof, comprising a float pump comprising an elongated tubular case having an intake and a discharge in the distal proximal end portions thereof, respectively, a piston in the bore of the case, and a rod for reciprocating the piston in the bore, there being a liquid flow annulus formed in the bore between the rod and the wall of the bore, and valve means whereby the liquid is intaken through the piston to the annulus and then delivered to the discharge through the annulus, the piston rod extending from the bore of the case so that when the distal end portion of the case is inserted downward into the body of the liquid to immerse the intake of the same below the static surface level of the liquid, and the proximal end portion of the case is retained above the static surface level of the liquid, to discharge the pump effluent thereabove, the rod extends to a point above the discharge, to enable the piston to be reciprocated therefrom, a reciprocable drive mechanism connected to the piston rod at the aforesaid point so that the piston, the rod, and the connection between the rod and the drive mechanism are constrained to reciprocate with one another as a unitary servo-system having a predetermined stroke paralleling the longitudinal axis of the case, means including a pair of crank arms adapted to be pedalled by a person with his legs to operate the drive mechanism and reciprocate the servo system at such stroke, and means whereby the level of the intake can be adjusted and the pump flooded to levels in the body of liquid and the annulus, respectively, at which the piston rod has an immersed length, relative to the bouyancy of the servo-system and the weight of the column of liquid in the annulus, at which the center of bouyancy and the center of gravity of the servo system reach a state of equalibrium each time that the servo-system passes through an intermediate point within the stroke thereof, so that a portion of the stroke, in each direction thereof, is powered by the negative or positive bouyancy of the servo-system.

34. A method of raising liquid to the atmosphere above the static surface level thereof with a float pump comprising an elongated tubular case having an intake and a discharge in the distal and proximal end portions thereof, respectively, a piston in the bore of the case, and a rod for reciprocating the piston in the bore, there being a liquid flow annulus formed in the bore between the rod and the wall of the bore which opens to atmosphere at the discharge, and valve means whereby the liquid is intaken through the piston to the annulus and then delivered to the discharge through the annulus, comprising inserting the distal end portion of the case downward into the body of liquid until the intake of the same is immersed below the static surface level of the liquid, retaining the proximal end portion of the case in the atmosphere above the static surface level of the liquid, to discharge the annulus into the atmosphere, extending the piston rod from the bore of the case to a point above the discharge, to enable the piston to be reciprocated therefrom, connecting a reciprocal drive mechanism to the piston rod at the aforesaid point so that the piston, the rod, and the connection between the rod and the drive mechanism are constrained to reciprocate with one another as a unitary servo-system having a predetermined stroke paralleling the longitudinal axis of the case, operating the drive mechanism to reciprocate the servo-system at such stroke, and adjusting the level of the intake and flooding the pump to levels in the body of liquid and the annulus, respectively, at which the piston rod has an immersed length, relative to the buoyancy of the servo-system and the weight of the column of liquid in the annulus, at which the center of buoyancy and the center of gravity of the servo-system reach a state of equilibrium each time that the servo system passes through an intermediate point within the stroke thereof, so that a portion of the stroke, in each direction thereof, is powered by the negative or positive buoyancy of the servo system, the body of liquid having insufficient depth and/or artesian head to accommodate the intake within it, a sump being formed in the bottom of the enclosure for the body of liquid, and the pump being inserted into the sump to place the intake at a depth therein at which the piston rod has the necessary length, and the material at the bottom of the enclosure being relatively liquid pregnable, and the sump being cased with a thimble-like water-tight liner for the same.

35. A method for raising liquid to the atmosphere above the static surface level thereof with a float pump comprising an elongated tubular case having an intake and a discharge in the distal and proximal end portions thereof, respectively, a piston in the bore of the case, and a rod for reciprocating the piston in the bore, there being a liquid flow annulus formed in the bore between the rod and the wall of the bore which opens to atmosphere at the discharge, and valve means whereby the liquid is intaken through the piston to the annulus and then delivered to the discharge through the annulus, comprising inserting the distal end portion of the case downward into the body of the liquid until the intake of the same is immersed below the static surface level of the liquid, retaining the proximal end portion of the case in the atmosphere above the static surface level of the liquid, to discharge the annulus into the atmosphere, extending the piston rod from the bore of the case to a point above the discharge, to enable the piston to be reciprocated therefrom, connecting a reciprocal drive mechanism to the piston rod at the aforesaid point so that the piston, the rod, and the connection between the rod and the drive mechanism are constrained to reciprocate with one another as a unitary servo-system having a predetermined stroke paralleling the longitudinal axis of the case, operating the drive mechanism to reciprocate the servo system at such stroke, and adjusting the level of the intake and flooding the pump to levels in the body of liquid and the annulus, respectively, at which the piston rod has an immersed length, relative to the buoyancy of the servo-system and the weight of the column of liquid in the annulus, at which the center of buoyancy and the center of gravity of the servo-system reach a state of equilibrium each time that the servosystem passes through an intermediate point within the stroke thereof, so that a portion of the stroke, in each direction thereof, is powered by the negative or positive buoyancy of the servo-system, the body of liquid being enclosed in a ground formation, the surface of the ground being contoured to have two or more tiers of surface, a plurality of float pump units being inserted in the ground formation, one below each tier, and the liquid being raised by each unit to the next successive tier thereabove, to discharge thereon.

36. A low horsepower apparatus for raising liquid to the atmosphere above the static surface level thereof, comprising a float pump comprising an elongated tubular case having an intake and a discharge in the distal and proximal end portions thereof, respectively, a piston in the bore of the case, and a rod for reciprocating the piston in the bore, there being a liquid flow annulus formed in the bore between the rod and the wall of the bore, which opens to atmosphere at the discharge, and valve means whereby the liquid is intaken through the piston to the annulus and then delivered to the discharge through the annulus, the piston rod extending from the bore of the case so that when the distal end portion of the case is inserted downward into the body of the liquid to immerse the intake of the same below the static surface level of the liquid, and the proximal end portion of the case is retained in the atmosphere above the static surface level of the liquid, to discharge the annulus into the atmosphere, the rod extends to a point above the discharge, to enable the piston to be reciprocated therefrom, a reciprocable drive mechanism connected to the piston rod at the aforesaid point so that the piston, the rod, and the connection between the rod and the drive mechanism are constrained to reciprocate with one another as a unitary servo-system having a predetermined stroke paralleling the longitudinal axis of the case, means for operating the drive mechanism to reciprocate the servo-system at such stroke, and means whereby the level of the intake can be adjusted and the pump flooded to levels in the body of liquid and the annulus, respectively, at which the piston rod has an immersed length, relative to the buoyancy of the servo-system and the weight of the column of liquid in the annulus, at which the center of buoyancy and the center of gravity of the servo-system reach a state of equilibrium each time that the servo-system passes through an intermediate point within the stroke thereof, so that a portion of the stroke, in each direction thereof, is powered by the negative or positive buoyancy of the servo-system, said apparatus further comprising means for forming a sump in the bottom of the enclosure for the body of liquid, so that the intake of the case can be inserted in the sump to a level therein at which the piston rod has the necessary length, and means for casing the sump with a thimble-like watertight liner for the same, where the material at the bottom of the enclosure is relatively liquid pregnable.

37. A low horsepower apparatus for raising liquid to the atmosphere above the static surface level thereof, comprising a float pump comprising an elongated tubular case having an intake and a discharge in the distal and proximal end portions thereof, respectively, a piston in the bore of the case, and a rod for reciprocating the piston in the bore, there being a liquid flow annulus formed in the bore between the rod and the wall of the bore, which opens to atmosphere at the discharge, and valve means whereby the liquid is intaken through the piston to the annulus and then delivered to the discharge through the annulus, the piston rod extending from the bore of the case so that when the distal end portion of the case is inserted downward into the body of the liquid to immerse the intake of the same below the static surface level of the liquid, and the proximal end portion of the case is retained in the atmosphere above the static surface level of the liquid, to discharge the annulus into the atmosphere, the rod extends to a point above the discharge, to enable the piston to be reciprocated therefrom, a reciprocable drive mechanism connected to the piston rod at the aforesaid point so that the piston, the rod, and the connection between the rod and the drive mechanism are constrained to reciprocate with one another as a unitary servo-system having a predetermined stroke paralleling the longitudinal axis of the case, means for operating the drive mechanism to reciprocate the servo-system at such stroke, and means whereby the level of the intake can be adjusted and the pump flooded to levels in the body of liquid and the annulus, respectively, at which the piston rod has an immersed length, relative to the buoyancy of the servo-system and the weight of the column of liquid in the annulus, at which the center of buoyancy and the center of gravity of the servo-system reach a state of equilibrium each time that the servo-system passes through an intermediate point within the stroke thereof, so that a portion of the stroke, in each direction thereof, is powered by the negative or positive buoyancy of the servo-system, the piston rod having a longitudinally extending cavity in the bore thereof, and the cavity being filled with a buoyancy adjusting filler material.

38. A low horsepower apparatus for raising liquid to the atmosphere above the static surface level thereof, comprising a float pump comprising an elongated tubular case having an intake and a discharge in the distal and proximal end portions thereof, respectively, a piston in the bore of the case, and a rod for reciprocating the piston in the bore, there being a liquid flow annulus formed in the bore between the rod and the wall of the bore, which opens to atmosphere at the discharge, and valve means whereby the liquid is intaken through the piston to the annulus and then delivered to the discharge through the annulus, the piston rod extending from the bore of the case so that when the distal end portion of the case is inserted downward into the body of the liquid to immerse the intake of the same below the static surface level of the liquid, and the proximal end portion of the case is retained in the atmosphere above the static surface level of the liquid, to discharge the annulus into the atmosphere, the rod extends to a point above the discharge, to enable the piston to be reciprocated therefrom, a reciprocable drive mechanism connected to the piston rod at the aforesaid point so that the piston, the rod, and the connection between the rod and the drive mechanism are constrained to reciprocate with one another as a unitary servo-system having a predetermined stroke paralleling the longitudinal axis of the case, means for operating the drive mechanism to reciprocate the servo-system at such stroke, and means whereby the level of the intake can be adjusted and the pump flooded to levels in the body of liquid and the annulus, respectively, at which the piston rod has an immersed length, relative to the buoyancy of the servo-system and the weight of the column of liquid in the annulus, at which the center of buoyancy and the center of gravity of the servo-system reach a state of equilibrium each time that the servo-system passes through an intermediate point within the stroke thereof, so that a portion of the stroke, in each direction thereof, is powered by the negative or positive buoyancy of the servo-system, the piston rod being constructed from the group consisting of light weight metal and polymer materials adapted to withstand the hydrostatic pressures ambient to the pump.

39. A low horsepower apparatus for raising liquid to the atmosphere above the static surface level thereof, comprising a float pump comprising an elongated tubular case having an intake and a discharge in the distal and proximal end portions thereof, respectively, a piston in the bore of the case, and a rod for reciprocating the piston in the bore, there being a liquid flow annulus formed in the bore between the rod and the wall of the bore, which opens to atmosphere at the discharge, and valve means whereby the liquid is intaken through the piston to the annulus and then delivered to the discharge through the annulus, the piston rod extending from the bore of the case so that when the distal end portion of the case is inserted downward into the body of the liquid to immerse the intake of the same below the static surface level of the liquid, and the proximal end portion of the case is retained in the atmosphere above the static surface level of the liquid, to discharge the annulus into the atmosphere, the rod extends to a point above the discharge, to enable the piston to be reciprocated therefrom, a reciprocable drive mechanism connected to the piston rod at the aforesaid point so that the piston, the rod, and the connection between the rod and the drive mechanism are constrained to reciprocate with one another as a unitary servo-system having a predetermined stroke paralleling the longitudinal axis of the case, means for operating the drive mechanism to reciprocate the servo-system at such stroke, and means whereby the level of the intake can be adjusted and the pump flooded to levels in the body of liquid and the annulus, respectively, at which the piston rod has an immersed length, relative to the buoyancy of the servo-system and the weight of the column of liquid in the annulus, at which the center of buoyancy and the center of gravity of the servo-system reach a state of equilibrium each time that the servo-system passes through an intermediate point within the stroke thereof, so that a portion of the stroke, in each direction thereof, is powered by the negative or positive buoyancy of the servo-system, the means for operating the drive mechanism including a stand for immobilizing a conventional bicycle while it is pedalled by a person sitting on the same, and means whereby the chain and sprocket power system of the bicycle can be interconnected with the drive mechanism to operate the same through the pedalling action of the person sitting on the bicycle.

* * * * *